US005357837A

United States Patent [19]

Disera

[11] Patent Number: 5,357,837

[45] Date of Patent: Oct. 25, 1994

[54] STAND UP WOODWIND MOUTHPIECE

[76] Inventor: William P. Disera, 555 Westminster St., Joliet, Ill. 60435

[21] Appl. No.: 702,882

[22] Filed: May 20, 1991

Related U.S. Application Data

[60] Continuation-in-part of Ser. No. 478,768, Feb. 12, 1990, Pat. No. D. 318,868, which is a division of Ser. No. 38,343, Apr. 14, 1987, Pat. No. D. 308,069.

[51] Int. Cl.[5] ..... G10D 9/02

[52] U.S. Cl. ..... 84/383 R

[58] Field of Search ..... 84/383 R, 383 A, 382; D17/13

[56] References Cited

U.S. PATENT DOCUMENTS

| | | | |
|---|---|---|---|
| D. 308,069 | 5/1990 | Disera | D17/13 |
| D. 318,868 | 8/1991 | Disera | D17/13 |
| 2,517,077 | 8/1950 | Berry | 84/383 R |
| 2,525,523 | 10/1950 | Chance | 84/383 R |
| 4,041,827 | 8/1977 | Daglis | 84/383 R |

*Primary Examiner*—Michael L. Gellner
*Assistant Examiner*—Eddie C. Lee
*Attorney, Agent, or Firm*—Willian Brinks Hofer Gilson & Lione

[57] ABSTRACT

A woodwind mouthpiece is disclosed that has a straight-through air passageway that produces richer and brighter tones while minimizing restrictive flow, turbulence and back pressure in the mouthpiece. The arrangement of the walls in selected planes, the position of the top wall with respect to the reed-supporting surface and the lay angle of the reed-supporting surface allow the instrument associated with the mouthpiece to be played in a variety of positions. Different lay angles can be designed into the mouthpiece. Other features are disclosed.

7 Claims, 2 Drawing Sheets

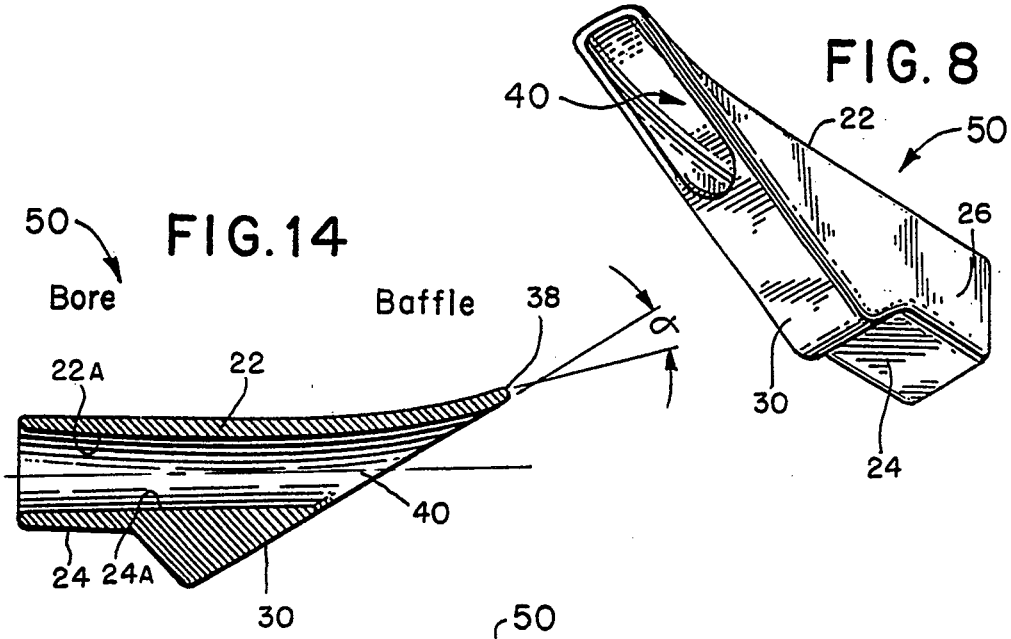
FIG. 14
FIG. 8
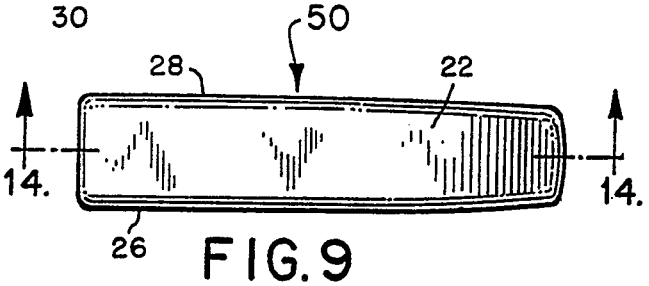
FIG. 9
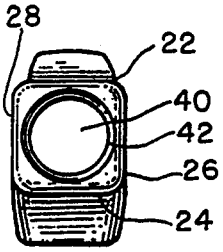
FIG. 10
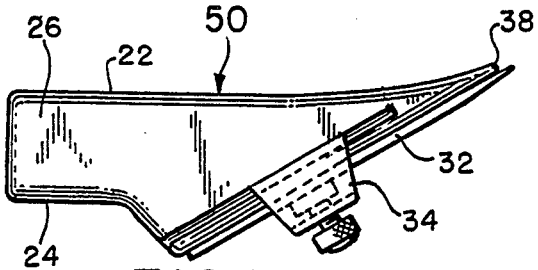
FIG. 11
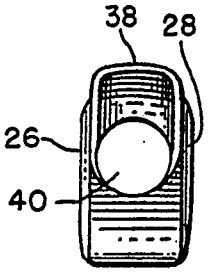
FIG. 12
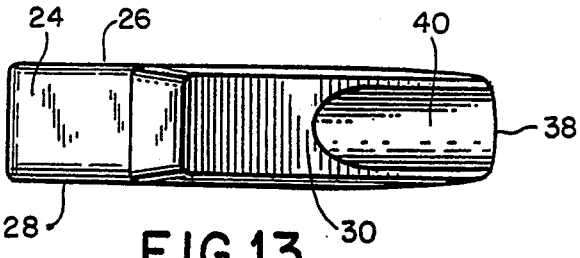
FIG. 13

STAND UP WOODWIND MOUTHPIECE

This is a continuation-in-part of U.S. patent Des. application, Ser. No. 07/478,768, filed on Feb. 12, 1990 and which issued as U.S. Pat. No. Des. 318,868 on Aug. 6, 1991. Ser. No. 07/478,768 was a divisional application of Design application, Ser. No. 038,343 filed on Apr. 14, 1987 which issued as U.S. Pat. No. Des. 308,069 on May 22, 1990.

FIELD OF THE INVENTION

The present invention relates generally to woodwind instrument mouthpieces. More particularly the invention relates to an improved mouthpiece which results in a greater volume capability with reduced back pressure, longer phrase capability, more controlled air flow and better note control throughout the range of the instrument. The improved mouthpiece can be installed easily on the instrument. The mouthpiece configuration and angle of lay also allows a player to hold the instrument comfortably in a plurality of positions, including in front of the body, with a secure and controllable embouchure grip, and prolongs the useful life of the reed.

BACKGROUND AND SUMMARY OF THE INVENTION

Many prior mouthpiece designs for woodwind instruments such as saxophones and clarinets have several undesirable characteristics. The configuration and direction for the air passageway through the baffle, and bore of the conventional mouthpiece detrimentally affects the manner in which the instrument plays and the quality of the resulting sound. The positioning of the baffle and the lay angle for the reed of the conventional mouthpiece combine with the passageway design to disrupt the air flow through and around the mouthpiece. As a consequence, it is difficult to attain proper note control and intonation of the sound throughout the full range of the instrument. The air turbulence, back pressure and flow restrictions in conventional mouthpieces further require the player to exert substantial effort to attain the necessary volume of flow that may be needed for long, sustained musical passages.

The configuration of conventional mouthpieces also restricts the variety of positions in which the instrument can be played comfortably and effectively, and the effectiveness of techniques that can be used by the player to create the desired musical effects. Prior mouthpiece designs also tended to cause saliva to accumulate on the reed, thereby reducing the useful life of the reed. Certain prior mouthpiece designs also create manufacturing and production difficulties.

The foregoing problems with certain prior mouthpiece designs are reduced or eliminated by the mouthpiece designed and manufactured in accordance with the present invention. A straight and unrestricted air passageway throughout the baffle, and bore of the mouthpiece in accordance with this invention, in combination with a selected position for the baffle and the lay surface for the reed, produce the desired improved playing and sound characteristics. It has been found that the mouthpiece in accordance with this invention produces a richer and brighter tone with more unrestricted and controlled air flow through the mouthpiece and the instrument.

Improved note control with the correct intonation is also accomplished throughout the full range of the instrument. The present mouthpiece design also facilitates the effective use of musical techniques, such as tonguing and vibrato. The design and construction of the mouthpieces in accordance with this invention also simplifies the positioning and adjustment of the mouthpiece on the instrument, and allows the instrument to be played in a variety of positions, including in front of the body, with comfort and ease. The useful life of the reed is also improved.

DESCRIPTION OF EXEMPLARY EMBODIMENTS

Further features and objects of the present invention will become apparent from the following description of exemplary embodiments thereof, as shown in the accompanying drawings. In the drawings:

FIG. 8 is a perspective view of a second embodiment of the mouthpiece in accordance with this invention;

FIG. 9 is a top plan view of the mouthpiece shown in FIG. 8;

FIG. 10 is a left end view of the mouthpiece shown in FIG. 9;

FIG. 11 is a side elevational view of the mouthpiece shown in FIG. 9, showing a reed and ligature in place on the mouthpiece;

FIG. 12 is a right end view of the mouthpiece shown in FIG. 9;

FIG. 13 is a bottom plan view of the mouthpiece shown in FIG. 9; and

FIG. 14 is a cross-sectional elevational view of the mouthpiece taken along the line 14—14 in FIG. 9.

Figure 1:
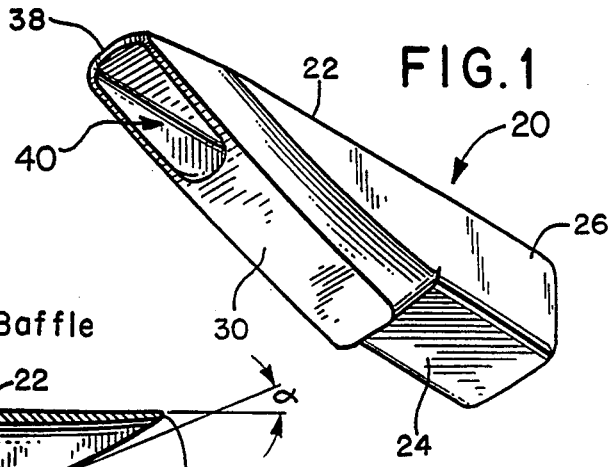
FIG. 1 is a perspective view of one embodiment of the mouthpiece constructed in accordance with the present invention.
Figure 7:
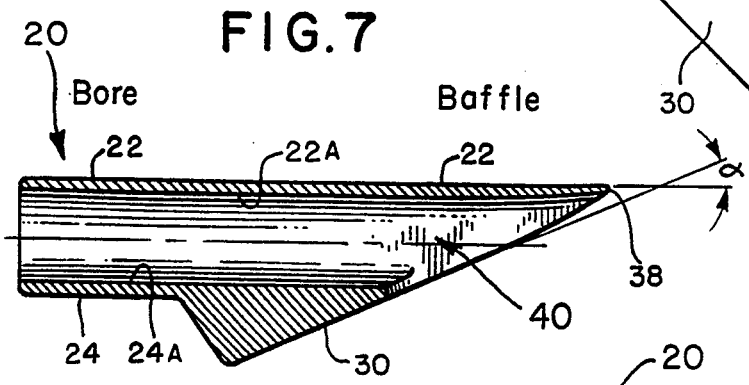
FIG. 7 is a cross-sectional view of the mouthpiece taken along the line 7—7 in FIG. 2.
Figure 2:
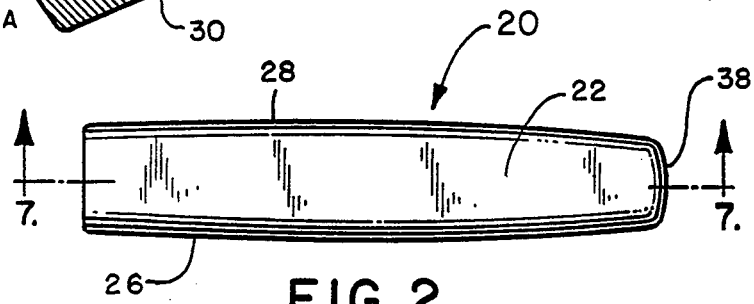
FIG. 2 is a top plan view of the mouthpiece shown in FIG. 1.
Figure 4:
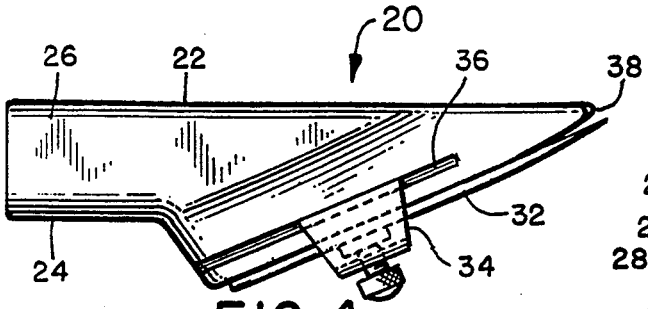
FIG. 4 is a side elevational view of the mouthpiece shown in FIG. 2 showing a reed and ligature in place on the mouthpiece.

The first embodiment of the mouthpiece constructed pursuant to the present invention is depicted in FIG. 1 by the reference numeral 20. Mouthpiece 20 is designed for use with a saxophone and includes a base defined by a top wall 22, bottom wall 24 and side walls 26, 28. An inclined lay surface 30 is positioned at a selected lay angle to the top wall 22, to define a surface for mounting a reed 32 on the mouthpiece 20. As shown in FIG. 7, the lay angle between the surface 30 and the top wall 22 is between about ten to twenty degrees, and is preferably approximately fifteen degrees. As shown in FIG. 4, the reed 32 is held in place on the lay surface 30 by a suitable adjustable ligature 34. In the illustrated embodiment, the ligature 34 is slidably mounted in grooves 36 provided on the side walls 26 and 28 and can be adjusted into the desired position to secure the reed 32 onto the mouthpiece 20.

As shown in FIG. 7, the mouthpiece 20 defines a bore portion at the left end for receiving the neck of a saxophone, not shown. The mouthpiece further defines a baffle portion at the right end. The baffle portion intersects the angled lay surface 30 at a tip rail 38, and constitutes the narrowed portion of the mouthpiece 20 that is inserted into the player's mouth between his or her lips and teeth.

Figure 5:
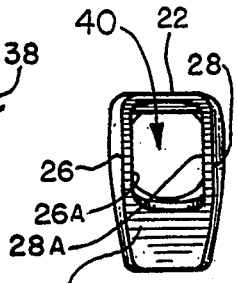
FIG. 5 is a right end view of the mouthpiece shown in FIG. 2.
Figure 6:
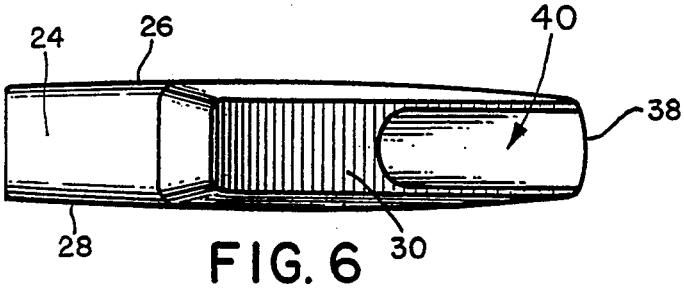
FIG. 6 is a bottom plan view of the mouthpiece shown in FIG. 2.

In the preferred embodiment of this invention, the top wall 22 of the mouthpiece throughout the bore, chamber and baffle portions define a common plane that can be held in a general horizontal position when the associated saxophone is played. As seen in FIGS. 4 and 5, the top wall 22 is also preferably flat so that the baffle portion provides a flat rather than a curved surface for contact by the lips and teeth of the player. The flat top wall for the baffle portion of the mouthpiece provides for a more relaxed but secure and controllable embouchure. This design facilitates the use of embouchure-controlled techniques by the musician, such as vibrato, single, double or triple tonguing, and the creation of subtones.

In normal use, the reed 32 is placed on the mouthpiece 20, and the ligature 34 is tightened, before the mouthpiece is placed on the instrument. The typical neck of the instrument has a cork surface area that is designed to seal the mouthpiece in place in a secure manner so that the mouthpiece does not move longitudinally on the neck or turn during play. Movement of the mouthpiece on the neck of the instrument cannot be allowed because the tune of the instrument, i.e., whether it is in tune, sharp or flat, is determined by the position of the mouthpiece on the neck. The same frictional forces between the mouthpiece and the cork portion of the neck that secure the mouthpiece in place also resist the placement of the mouthpiece on the neck in the proper place in the first instance. Thus in a typical situation, the mouthpiece, after the reed 32 is in place, must be twisted and turned forcefully onto the cork portion of the neck, to attach the mouthpiece to the instrument and position it so that the instrument is in tune.

Conventional mouthpieces that are oval or round in shape have presented problems when the mouthpiece is mounted on the instrument. The forceful twisting and turning of the mouthpiece during the mounting operation can cause the ligature and reed on the mouthpiece to slide and become displaced. This displacement of the ligature and reed is even more common if the cork surface on the neck is dry. These designs made the mouthpieces difficult to grip without disrupting the position of the ligature and reed.

Figure 3:
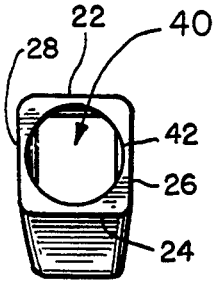
FIG. 3 is a left end view of the mouthpiece shown in FIG. 2.

This difficulty is avoided in the preferred embodiment of the present invention by providing the mouthpiece with flat exterior walls. As seen in FIGS. 3, 4, and 5, the top wall 22 and the side walls 26,28 are flat rather than being round or oval in shape. This configuration permits the secure gripping of the mouthpiece during the installation or removal operation, without any substantial gripping of the ligature 34 and reed 32. The reed 32 will therefore stay in its proper position during the installation, tuning and removal operations. The flat wall surfaces further allow more economical and efficient machining and manufacture of the mouthpiece 20.

As seen in FIG. 7, the base of the mouthpiece 20 in accordance with this invention defines an air passageway 40 having parallel opposed internal surfaces 22A,24A, and 26A,28A. The passageway 40 is straight and continuous, with a substantially uniform cross-sectional area, throughout the baffle, chamber and bore portions of the mouthpiece 20. One end of the passageway 40 terminates in a cylindrical opening 42 in the bore portion for receiving the round neck of the instrument. The other end of the passageway 40 intersects the plane of the lay surface 30 so that the reed 32 can be positioned across the baffle end of the passageway. Since the central axis of the passageway 30 in this embodiment is parallel to the top wall 22, the lay surface likewise intersects the passageway at an angle alpha between about 10 to 20 degrees.

This straight-through air passageway 40 is the result of arranging the baffle portion of the mouthpiece upwardly in alignment with the bore and chamber portions, with the passageway being essentially parallel to the upper wall 22. In contrast to prior mouthpieces having a baffle positioned in a downward or slanted location, the mouthpiece 20 with the raised baffle portion and the straight-through passageway 40 does not restrict the air flow or create turbulence or back pressure during use. The improved air flow produces richer and brighter tones and better note control for the full range of the instrument. More air volume and sound can also be created with less effort due to the straight and uniform air passageway 40.

It has been found that the straight-through passageway 40 extending through the baffle, chamber and bore portions of the mouthpiece 20 improves the note control and intonation of the instrument so that the upper and lower note registers can be played with essentially the same ease, and with the same embouchure, as the middle registers eliminating the favoring of high and low notes in the upper and lower registers. The free flow of air through the mouthpiece substantially eliminates back pressure within the mouth of the musician caused by the deflection of air by mouthpieces with a downward or slanted baffle design. More air volume thus can be created with less effort, to produce rich tones and subtones, and volume changes can be made with less effort to produce different levels of sound. The straight-through passageway is likewise cheaper and easier to manufacture than passages that are convoluted or restricted.

The mouthpiece 20 also accommodates modern musicians that desire to change the playing position of the instrument, for example, during stand-up playing or marching assignments. During such events it is common for a player to raise the instrument to a higher level and hold it in front of his or her body. Such a playing position upsets the air flow through the mouthpiece and instrument, and the posture and embouchure of the player, if conventional mouthpieces are used. In the mouthpiece 20 the straight top wall 22 at the baffle portion of the mouthpiece, in combination with the acute lay angle alpha for the surface 30, allows the instrument to be used comfortably and effectively in the raised and forward position. The positioning or the top wall 22 of the mouthpiece 20 in a substantially horizontal position will maintain the correct air flow, posture and embouchure. The acute angle of lay for the table surface 30 and the attached reed 32 also improves the results or vibrato and tonguing techniques by allowing more space in which the musician can move his or her jaw or tongue.

The angle of the reed 32 on the lay surface 30 also causes the saliva that accumulates in the mouthpiece to flow downwardly away from the playing end of the reed and into the instrument. This arrangement keeps the reed from getting water-logged during prolonged play, and extends the life of the reed.

FIGS. 8–14 illustrate a second embodiment of a mouthpiece 50 in accordance with the present invention. Many of the components and features of the mouthpiece 50 are the same as the mouthpiece 20. Like parts have been provided with the same reference numerals in FIGS. 8–14. In the mouthpiece 50 the baffle portion of the top wall 22 is angled upwardly by a selected degree from the plane of the wall 22 at the bore portions of the mouthpiece. The lay angle alpha that the baffle portion makes with the lay surface 30 on which the reed 32 is mounted is thereby changed from the angle used in the mouthpiece 20. The configuration of the mouthpiece in accordance with this invention allows this angular relationship to be designed to provide a variety of mouthpieces to suit the playing posture and embouchure requirements of different players. Players using the mouthpiece 50 would therefore be able to hold the instrument in a higher than normal position, such as during stand-up playing or marching, without interfering with the playing and sound characteristics, and the other features described above, that are produced by the mouthpiece embodying the features of the present invention.

The foregoing descriptions of exemplary embodiments of this invention are provided for illustrative purposes only. Numerous modifications will readily occur to those skilled in the art, and can be resorted to without departing from the scope of this invention as set forth in the accompanying claims.

What is claimed is:

1. A woodwind mouthpiece, one end of which is adapted to be engaged by the players mouth and teeth and the other end of which is adapted to be installed in a woodwind instrument, comprising:

a base member having a generally elongated shape extending along an axis and being defined by side walls, a top wall and a bottom wall defining an air passageway extending along said axis through said base member which includes a baffle portion adapted to be engaged by the mouth and teeth of the player and a bore portion that is adapted to connect the mouthpiece to a woodwind instrument;

said air passageway provided within the base member extending substantially straight through the baffle and bore portions and having a substantially uniform cross-sectional area therealong; and a lay surface defined by the bottom wall at a selected acute angle with respect to the axis of said passageway and intersecting the top wall, said lay surface adapted for supporting a reed on the mouthpiece across an open end of said air passageway adjacent the baffle portion of the mouthpiece.

2. A mouthpiece in accordance with claim 1 wherein the top wall of the mouthpiece extends along a plane and the axis of the air passageway is substantially parallel to said plane.

3. A mouthpiece in accordance with claim 2 wherein the top wall along the baffle portion of the mouthpiece extends upwardly at a selected angle from said plane at a selected angle with respect to said lay surface.

4. A mouthpiece in accordance with claim 1 wherein said top wall and side walls define substantially flat exterior surfaces to accommodate the installation and removal of the mouthpiece from an instrument and said substantially flat exterior surface of said top wall allows more teeth to mouthpiece contact for a more secure and controllable embouchure.

5. A mouthpiece in accordance with claim 1 wherein the base includes means to receive a reed-supporting ligature.

6. A mouthpiece in accordance with claim 1 wherein the acute angle between the lay surface and the axis of the air passageway is in the range of about ten to twenty degrees.

7. A mouthpiece in accordance with claim 6 wherein said acute angle is approximately fifteen degrees.

* * * * *